US005223666A

United States Patent [19]

Delaney, Jr.

[11] Patent Number: 5,223,666

[45] Date of Patent: Jun. 29, 1993

[54] APPARATUS FOR CLEARING MINES

[75] Inventor: John E. Delaney, Jr., Alexandria, Va.

[73] Assignee: The United States of America as represented by the Secretary of the Navy, Washington, D.C.

[21] Appl. No.: 894,319

[22] Filed: Jun. 4, 1992

[51] Int. Cl.[5] ..... F42B 12/04; F42B 12/10; F42B 12/16

[52] U.S. Cl. ..... 102/476; 102/306

[58] Field of Search ..... 102/305, 306, 307, 308, 102/309, 310, 475, 476, 701

[56] References Cited

U.S. PATENT DOCUMENTS

| | | | |
|---|---|---|---|
| 2,433,875 | 1/1948 | Walker et al. | 89/1.13 |
| 2,460,322 | 2/1949 | Walker | 89/1.13 |
| 2,804,823 | 9/1957 | Jablonsky | 102/476 |
| 3,090,306 | 5/1963 | Reuther | 102/305 |
| 3,112,669 | 12/1963 | Damblanc | 89/1.13 |
| 3,498,177 | 3/1970 | Moro | 89/1.13 |
| 3,750,582 | 8/1973 | Kintish et al. | 102/476 |
| 4,632,036 | 12/1986 | Ringel | 102/476 |
| 4,649,829 | 3/1987 | Henderson et al. | 102/306 |
| 4,803,928 | 2/1989 | Kramer et al. | 102/476 |
| 4,829,901 | 5/1989 | Yates | 102/306 |
| 4,967,666 | 11/1990 | Kellner et al. | 102/476 |
| 5,003,884 | 4/1991 | Nissl et al. | 102/476 |
| 5,033,387 | 7/1991 | Lips | 102/476 |

FOREIGN PATENT DOCUMENTS

| | | | |
|---|---|---|---|
| 2132567 | 7/1984 | United Kingdom | 89/1.13 |
| 2207986 | 2/1989 | United Kingdom | 102/402 |

*Primary Examiner*—David H. Brown

*Attorney, Agent, or Firm*—Tamara L. Weber; Edward J. Connors, Jr.; William C. Townsend

[57] ABSTRACT

An abstract is provided which is capable of clearing encased explosives such as land mines. This apparatus combines a shaped charge jet with a plate penetrator. A depression is formed in a column of a first explosive material. The depression is provided with a metal liner such that detonation of the first explosive material forms a shaped charge jet. The shaped charge jet passes through a hole in a plate penetrator and exits the device without detonating a second explosive material. The shaped charge jet strikes the ground and imparts kinetic energy. As the energy in the shaped charge jet is consumed, the second explosive material detonates and drives the plate penetrator to supersonic velocities. Since shaped charge jet velocity exceeds the detonation velocity of the second explosive material, the shaped charge jet clears a path ahead of the plate penetrator. This results in higher velocity when the plate penetrator impacts the encased explosive, and consequently a greater chance of inducing explosion and neutralization.

16 Claims, 10 Drawing Sheets

APPARATUS FOR CLEARING MINES

FIELD OF THE INVENTION

This invention provides an apparatus which is capable of destroying both buried and surface laid encased explosives such as land mines.

BACKGROUND OF THE INVENTION

During military operations, it is necessary to neutralize mines. A mine can be neutralized by causing an explosion above the mine. This explosion will create energy waves which detonate the mine. An explosive charge can be placed above each individual mine. However, individually exploding each mine in a mine field would be a slow process and would require knowledge of the precise location of each mine. Large quantities of explosives may be spread over a mine field to quickly detonate all mines. This has the advantage of decreasing the length of time required for the operation, but is only effective with mines which are susceptible to initiation from a single, short duration, pressure pulse. Deeply buried mines or mines insensitive to pressure pulses could not be neutralized by this method.

SUMMARY OF THE INVENTION

This apparatus for destroying mines is capable of destroying both buried and surface laid encased explosives such as land mines. This device combines a plate penetrator with a shaped charge jet. The shaped charge jet is formed using the Munroe Effect. The Munroe Effect provides that a depression at the end of a column of explosives concentrates the shock wave from explosion along the axis of the charge. This increases the local penetration of the shock wave. If the depression is lined with metal, a shaped charge jet is formed. This shaped charge jet is projected forward at high velocity and can penetrate to great depths.

The subject apparatus for destroying mines is employed by first igniting the detonating composition. The detonating composition is ignited by igniting a detonating cord with a blasting cap or any other suitable initiating device. The energy released during the explosion of the detonating composition causes detonation of a first explosive material. As the first explosive material detonates, a shaped charge jet is formed. The shaped charge jet passes through apertures in the center of a second explosive material and a plate penetrator. The shaped charge jet then exits the device without detonating the second explosive material. The shaped charge jet strikes the ground and imparts kinetic energy. This reduces ground density in the region where the shaped charge jet passed. As the shaped charge jet is consumed, the second explosive material detonates and drives the plate penetrator to supersonic velocities. Since shaped charge jet velocity exceeds the detonation velocity of the second explosive material, the shaped charge jet clears a path ahead of the plate penetrator. This results in higher velocity when the plate penetrator impacts the mine main charge explosive and consequently a greater chance of inducing explosion and neutralization.

BRIEF DESCRIPTION OF THE DRAWINGS

The invention will be best understood by referring to the accompanying drawings, wherein.

DETAILED DESCRIPTION

Figure 1:
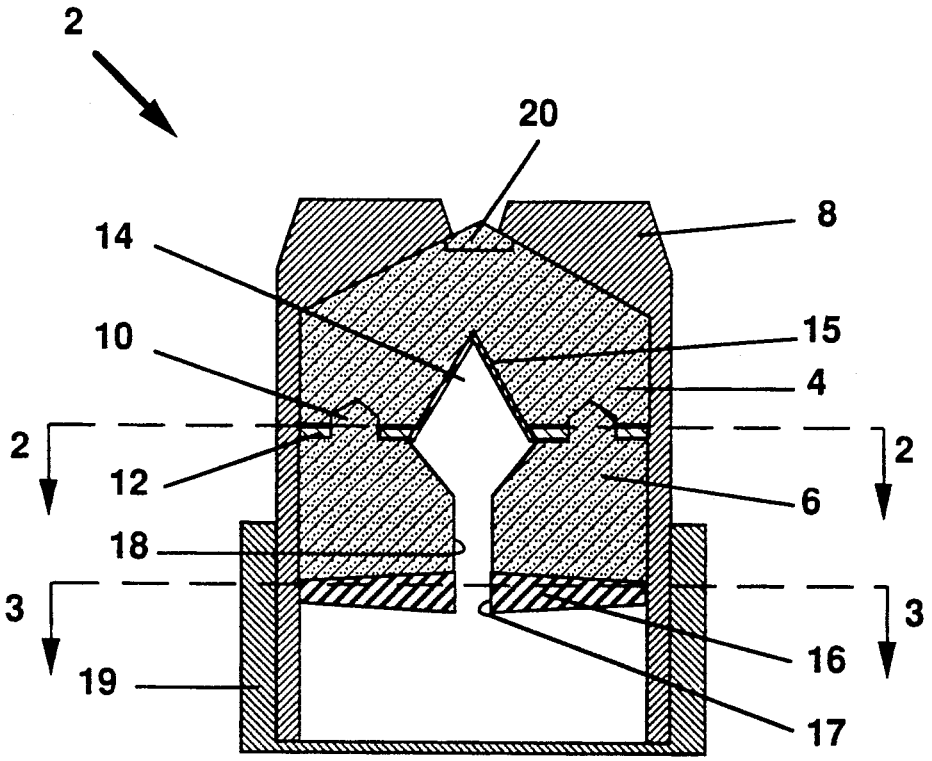
FIG. 1 is a cross sectional view of the apparatus for destroying mines with a conical liner.
Figure 2:
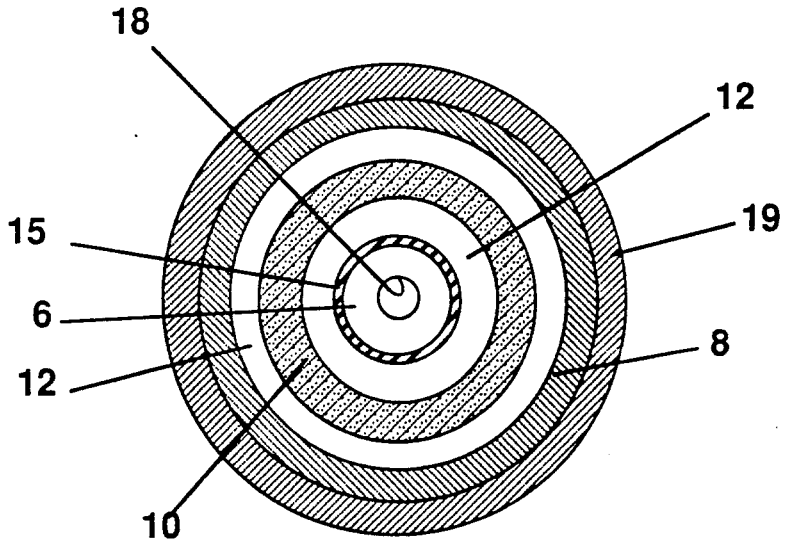
FIG. 2 is a sectional view taken on line 2—2 of FIG. 1.
Figure 3:
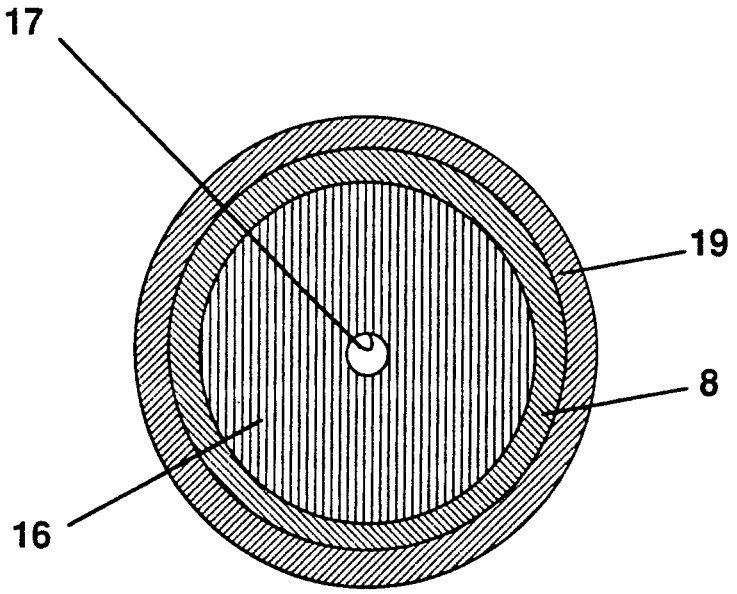
FIG. 3 is a sectional view taken on line 3—3 of FIG. 1.

FIG. 1, FIG. 2, and FIG. 3 illustrate an apparatus for destroying mines 2 with a conical liner 15. A first explosive material 4 and a second explosive material 6 are encased in an inert housing 8. The first explosive material 4 consists of either cyclonite (RDX); octogen (HMX); octol (a combination of HMX and TNT); or any other explosive suitable for creating a shaped charge jet. The second explosive material 6 consists of a hollow cylinder of cyclonite, octogen, or octol. Alternatively, different explosives could be used for the second explosive material 6 so long as the second explosive material 6 detonates at the same rate or slower than the first explosive material 4.

An initiation control 10 consists of a ring of the second explosive material 6 which projects into the first explosive material 4. The initiation control 10 permits the detonation in the first explosive material 4 to spread to the second explosive material 6 at a controlled rate. The inert housing 8 is composed of a thermoplastic carbonate-linked polymer such as LEXAN TM. Alternatively, other plastics or aluminum may be used to form the inert housing 8.

An inert separator 12 is located between the first explosive material 4 and the second explosive material 6. The inert separator 12 shapes the detonation wave and slows the rate of explosion of the first explosive material 4 and the second explosive material 6. The shape of the shock wave which develops as the first explosive material 4 explodes depends upon the size and shape of the inert separator 12. The inert separator 12 is composed of a thermoplastic carbonate-linked polymer such as LEXAN TM. Alternatively, the inert separator 12 may be formed from rubber.

The first explosive material 4 is shaped as a solid cylinder with a cavity 14 at the end nearest the inert separator 12. A conical liner 15 covers the surface of the cavity 14 in the first explosive material 4. This conical liner 15 consists of copper. Alternatively, the conical liner 15 may be aluminum.

A plate penetrator 16 is located inside the inert housing 8 under the second explosive material 6. The plate penetrator 16 consists of a circular plate of 304L stainless steel. The plate penetrator 16 is thicker towards the center than at the periphery. The plate penetrator 16 has a plate penetrator aperture 17 which is of approximately the same diameter as the second explosive material aperture 18 in the hollow center of the second explosive material 6.

A protective cap 19 covers the bottom of the inert housing 8. This protective cap 19 protects the plate penetrator 16 from damage during deployment of the apparatus for destroying mines 2.

An initiation point 20 projects from the first explosive material 4 to the exterior of the inert housing 8. This initiation point 20 consists of a detonating composition such as pentaerythritol tetranitrate (PETN) injected into a plastic such as LEXAN TM.

Figure 4:
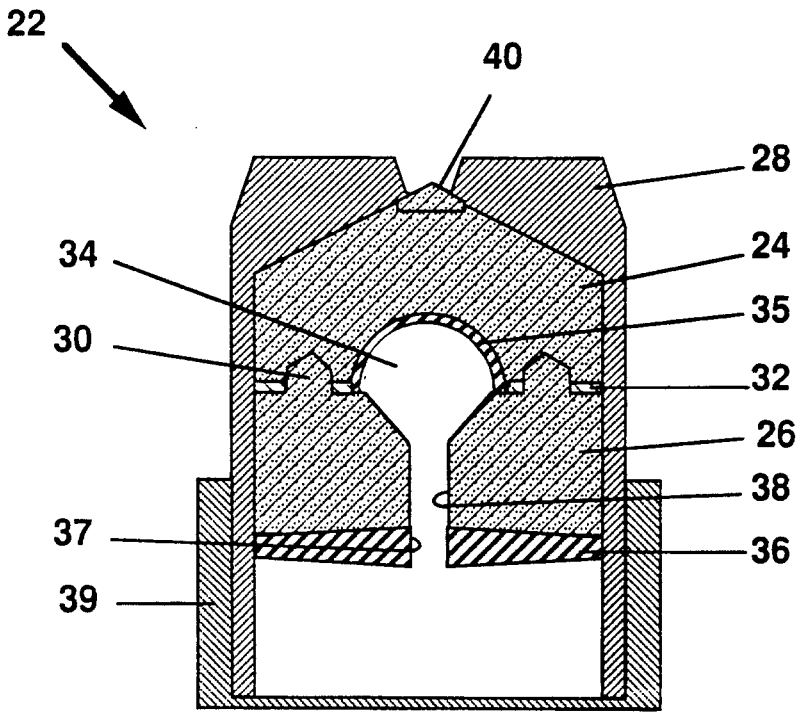
FIG. 4 is a cross sectional view of the apparatus for destroying mines with a hemispherical liner.

FIG. 4 illustrates an apparatus for destroying mines 22 with a hemispherical liner 35. A first explosive material 24 and a second explosive material 26 are encased in an inert housing 28. The first explosive material 24 consists of cyclonite (RDX); octogen (HMX); octol (a mixture of HMX and TNT); or any other explosive suitable for creating a shaped charge jet. The second explosive material 26 consists of a hollow cylinder of cyclonite, octogen, or octol. Alternatively, different explosives could be used for the second explosive material 26 so long as the second explosive material 26 detonates at the same rate or slower than the first explosive material 24.

An initiation control 30 consists of a ring of the second explosive material 26 which projects into the first explosive material 24. The initiation control 30 permits the detonation in the first explosive material 24 to spread to the second explosive material 26 at a controlled rate. The inert housing 28 is composed of a thermoplastic carbonate-linked polymer such as LEXAN TM. Alternatively, other plastics or aluminum may be used to form the inert housing 28.

An inert separator 32 is located between the first explosive material 24 and the second explosive material 26. The inert separator 32 is composed of a thermoplastic carbonate-linked polymer such as LEXAN TM. Alternatively, the inert separator 32 may be formed from rubber.

The first explosive material 24 is shaped as a solid cylinder with a cavity 34 at the end nearest the inert separator 32. A hemispherical liner 35 covers the surface of the cavity 34 in the first explosive material 24. This hemispherical liner 35 consists of copper. Alternatively, the hemispherical liner 35 may be aluminum.

A plate penetrator 36 is located inside the inert housing 28 under the second explosive material 26. The plate penetrator 36 consists of a circular plate of 304L stainless steel. The plate penetrator 36 is thicker towards the center than at the periphery. The plate penetrator 36 has a plate penetrator aperture 37 which is of approximately the same diameter as the second explosive material aperture 38 in the hollow center of the second explosive material 26

A protective cap 39 covers the bottom of the inert housing 28. This protective cap 39 protects the plate penetrator 36 from damage during deployment of the apparatus for destroying mines 22.

An initiation point 40 projects from the first explosive material 24 to the exterior of the inert housing 28. This initiation point 40 consists of a detonating composition such as pentaerythritol tetranitrate (PETN) injected into a plastic such as LEXAN TM.

Figure 5:
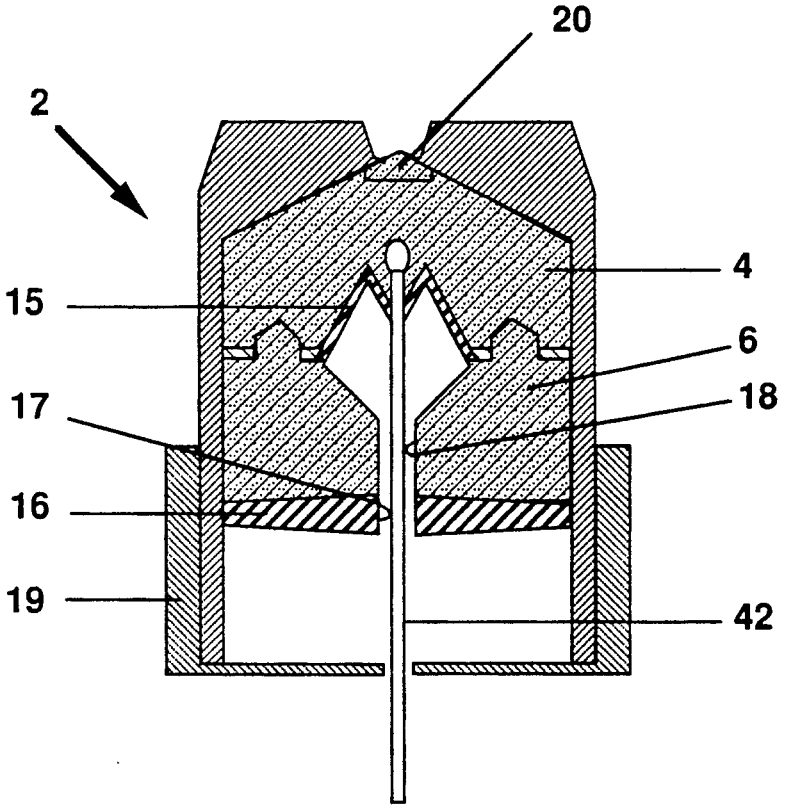
FIG. 5 is a cross sectional view of an apparatus for destroying mines shown at the time of initiation of the first explosive material.

FIG. 5 illustrates the apparatus for destroying mines 2 shown at the time of detonation of the first explosive material 4. The explosion is initiated at the initiation point 20. The energy released during the explosion of the detonating composition in the initiation point 20 causes detonation of the first explosive material 4. Due to the Munroe effect, explosion of the first explosive material 4 causes the conical liner 15 to form a shaped charge jet 42. The shaped charge jet 42 is a very thin, extremely high-velocity liquid jet. The shaped charge jet 42 passes through the second explosive material aperture 18 and the plate penetrator aperture 17 of the plate penetrator 16 without detonating the second explosive material 6. The shaped charge jet 42 easily penetrates the protective cap 19 as the shaped charge jet 42 exits the apparatus for destroying mines 2.

Figure 6:
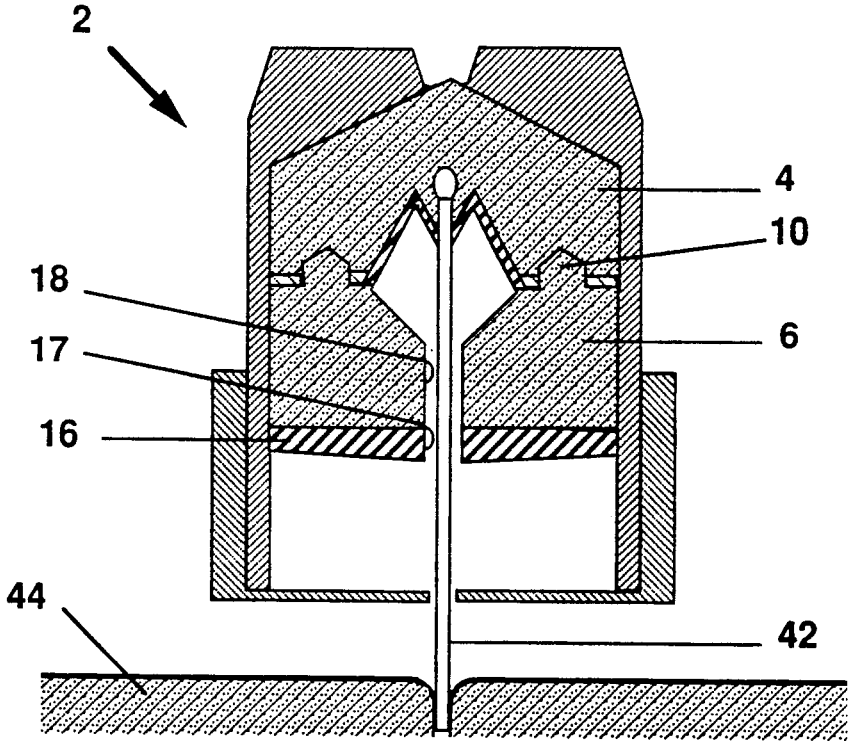
FIG. 6 is a cross sectional view of an apparatus for destroying mines shown at the time of initiation of the second explosive material.

FIG. 6 illustrates the apparatus for destroying mines 2 at the time of initiation of the second explosive material 6. The shaped charge jet 42 passes through the second explosive material aperture 18 and the plate penetrator aperture 17 of the plate penetrator 16 and begins to penetrate the ground 44. The explosion in the first explosive material 4 spreads through the initiation control 10 into the second explosive material 6.

Figure 7:
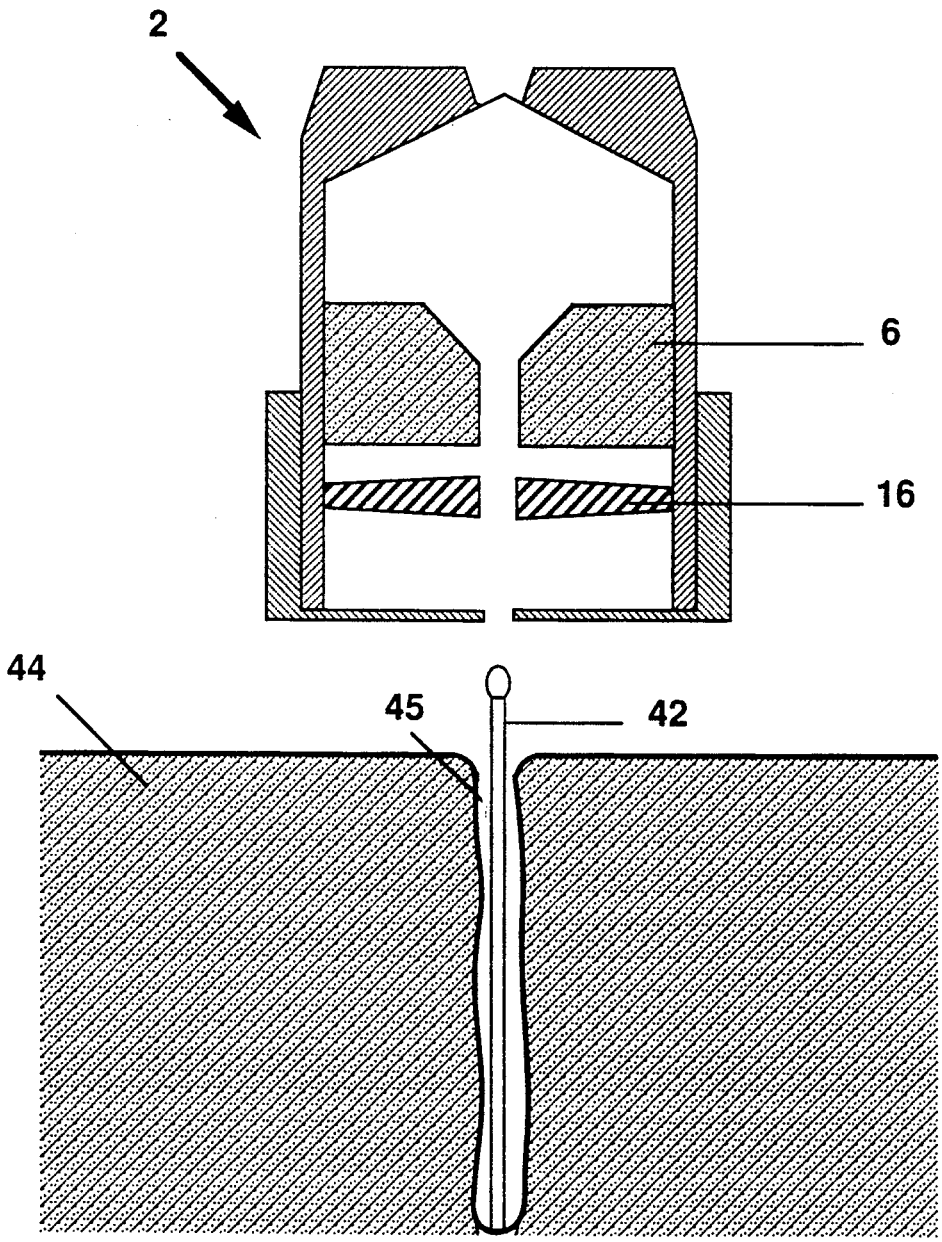
FIG. 7 is a cross sectional view of an apparatus for destroying mines shown as the second explosive material detonates and drives the plate penetrator towards the ground.

FIG. 7 illustrates the apparatus for destroying mines 2 as the second explosive material 6 detonates and drives the plate penetrator 16 towards the ground 44. As the shaped charge jet 42 creates a path 45 in the ground 44, the second explosive material 6 detonates and drives the plate penetrator 16 to supersonic velocities. It should be noted that the shaped charge jet 42 can be used to penetrate sand, soil, water, and a vast number of other materials.

Figure 8:
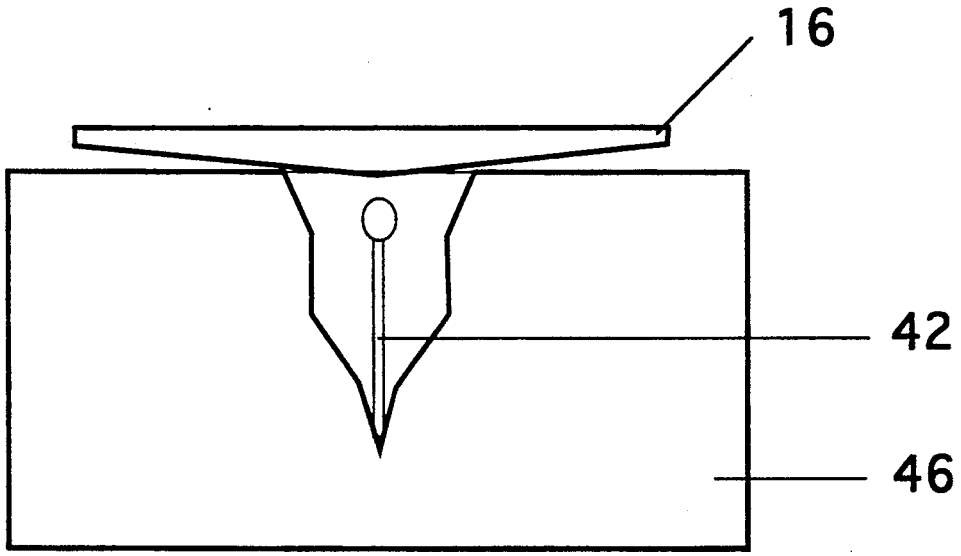
FIG. 8 illustrates the plate penetrator as it impacts a mine.

FIG. 8 illustrates a plate penetrator 16 as it impacts a mine 46. The mine 46 is shown schematically. The shaped charge jet 42 pierces the case holding the mine 46 and exposes the explosives in the mine 46 to the plate penetrator 16.

Figure 9:
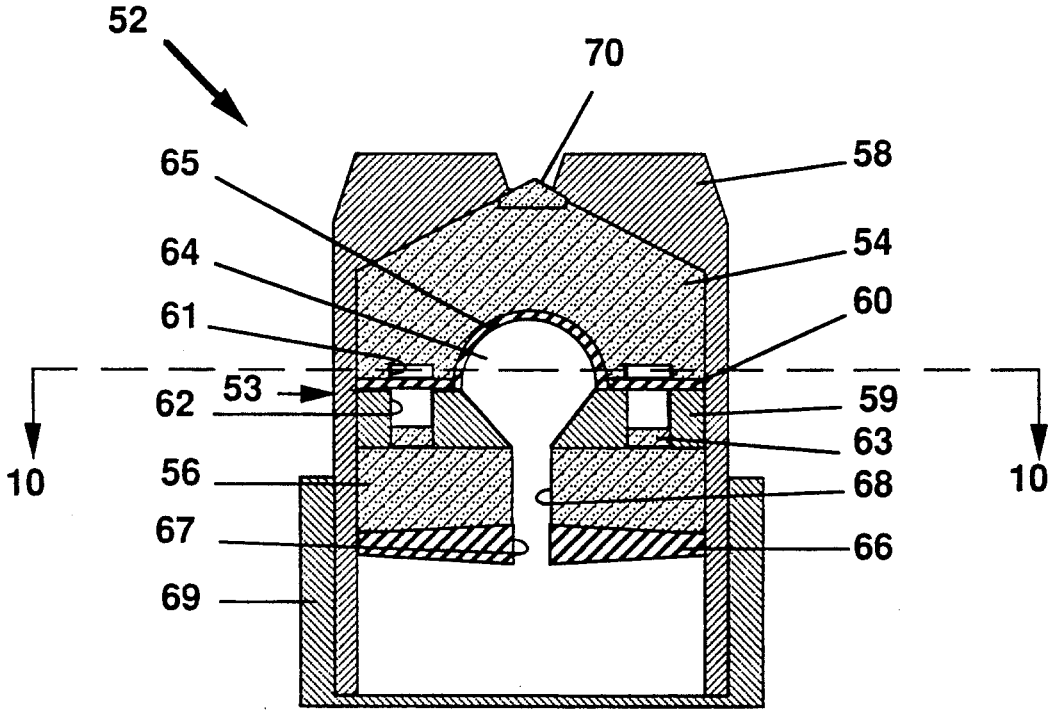
FIG. 9 illustrates a cross sectional view of the apparatus for destroying mines with an explosive clock.
Figure 10:
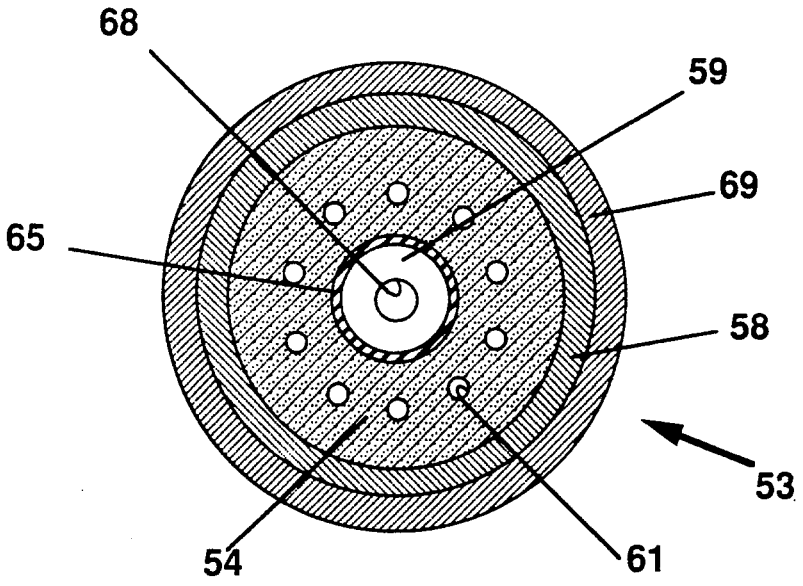
FIG. 10 is a sectional view taken on line 10—10 of FIG. 9.

FIG. 9 and FIG. 10 illustrate an apparatus for destroying mines 52 with an explosive clock 53. A first explosive material 54 and a second explosive material 56 are encased in an inert housing 58. The first explosive material 54 consists of cyclonite (RDX); octogen (HMX); octol (a mixture of HMX and TNT); or any other explosive suitable for creating a shaped charge jet. The second explosive material 56 consists of a hollow cylinder of cyclonite, octogen, or octol. Alternatively, different explosives could be used for the second explosive material 56 provided the second explosive material 56 detonates at the same rate or slower than the first explosive material 54.

An inert separator 59 is located between the first explosive material 54 and the second explosive material 56. The inert separator 59 is composed of a thermoplastic carbonate-linked polymer such as LEXAN TM. Alternatively, the inert separator 59 may be formed from rubber.

The explosive clock 53 uses shaped charge jets to provide a time delay between the explosion of the first explosive material 54 and the explosion of the second explosive material 56. A flyer plate 60 separates first explosive material apertures 61 from inert separator apertures 62. The flyer plate 60 consists of either copper, steel (particularly stainless steel), or aluminum. The rate of detonation of the explosive clock 53 can be varied by proper selection of flyer plate 60 material since denser flyer plate 60 materials will travel slower. The rate of detonation of the explosive clock 53 can also be varied by selecting the height of the first explosive material apertures 61 and the inert separator apertures 62. A booster explosive 63 may be located at the lower end of the inert separator apertures 62. The booster explosive 63 would be used to ensure that the shaped charge jets formed in the explosive clock 53 detonate the second explosive material 56.

The inert housing 58 is composed of a thermoplastic carbonate-linked polymer such as LEXAN TM. Alternatively, other plastics or aluminum may be used to form the inert housing 58.

The first explosive material 54 is shaped as a cylinder with a cavity 64 at the end nearest the inert separator 59. A hemispherical liner 65 covers the surface of the cavity 64 in the first explosive material 54. This hemispherical liner 65 consists of copper. Alternatively, the hemispherical liner 65 may be aluminum.

A plate penetrator 66 is located inside the inert housing 58 under the second explosive material 56. The plate penetrator 66 consists of a circular plate of 304L stainless steel. The plate penetrator 66 is thicker towards the center than at the periphery. The plate penetrator 66 has a plate penetrator aperture 67 which is of approximately the same diameter as the second explosive material aperture 68 in the hollow center of the second explosive material 56.

A protective cap 69 covers the bottom of the inert housing 58. This protective cap 69 protects the plate penetrator 66 from damage during deployment of the apparatus for destroying mines 52.

An initiation point 70 projects from the first explosive material 54 to the exterior of the inert housing 58. This initiation point 70 consists of a detonating composition such as pentaerythritol tetranitrate (PETN) injected into a plastic such as LEXAN TM.

This invention has been described in detail with particular reference to certain preferred embodiments thereof, but it should be understood that variations and modifications can be effected within the spirit and scope of the invention. It is particularly noted that substituting a hemispherical liner for a conical liner results in quicker shaped charge jet formation with a thicker and slower shaped charge jet.

What is claimed is:

1. A device comprising:

a first explosive material with a cavity, a metal liner covering the surface of said cavity in said first explosive material, a second explosive material, an initiation control, wherein said initiation control consists of a piece of said second explosive material which projects into said first explosive material, whereby an explosion in said first explosive material spreads through said initiation control into said second explosive material, a plate penetrator, and an inert housing surrounding said first explosive material, said metal liner, said second explosive material, said initiation control, and said plate penetrator.

2. The device of claim 1 wherein said plate penetrator comprises a stainless steel plate which is thicker towards the center than at the periphery and which contains an aperture at the center.

3. The device of claim 1 wherein said plate penetrator comprises an aluminum plate which is thicker towards the center than at the periphery and which contains an aperture at the center.

4. The device of claim 1 further comprising an inert separator located between said first explosive material and said second explosive material, wherein the size and shape of said inert separator influences the shape of the shock wave which develops as said first explosive material detonates.

5. The device of claim 4 wherein said metal liner covering the surface of said cavity in said first explosive material comprises a conical liner.

6. The device of claim 5 wherein said metal liner covering the surface of said cavity in said first explosive material comprises an aluminum liner.

7. The device of claim 5 wherein said metal liner covering the surface of said cavity in said first explosive material comprises a copper liner.

8. The device of claim 7 further comprising an initiation point projecting from said first explosive material to the exterior of said inert housing.

9. The device of claim 4 wherein said metal liner covering the surface of said cavity in said first explosive material comprises a hemispherical liner.

10. The device of claim 9 wherein said metal liner covering the surface of said cavity in said first explosive material comprises an aluminum liner.

11. The device of claim 9 wherein said metal liner covering the surface of said cavity in said first explosive material comprises a copper liner.

12. The device of claim 11 further comprising an initiation point projecting from said first explosive material to the exterior of said inert housing.

13. The device of claim 12 further comprising a protective cap which covers the bottom of said inert housing.

14. An apparatus for clearing mines comprising:

a first explosive material with a cavity and a plurality of apertures, a metal liner covering the surface of said cavity in said first explosive material, a second explosive material, an inert separator with a plurality of apertures, wherein said inert separator is located between said first explosive material and said second explosive material, a flyer plate located between said first explosive material and said inert separator, a plate penetrator, a plastic housing surrounding said first explosive material, said metal liner, said second explosive material, said inert separator, said flyer plate, and said plate penetrator, an initiation point projecting from said first explosive material to the exterior of said plastic housing.

15. A method for destroying a target comprising the steps of:

forming a first explosive material into a solid cylinder with a cavity at one end, lining said cavity with a metal liner, forming a second explosive material into a cylinder with a central aperture, placing an inert separator between said first explosive material and said second explosive material, projecting a piece of said second explosive material into said first explosive material, placing said first explosive material, said second explosive material, and said inert separator into an inert housing, placing a detonating composition between said first explosive material and the exterior of said inert housing, placing a plate penetrator into said inert housing, and igniting said detonating composition, whereby said detonating composition detonates said first explosive material such that a shaped charge jet is propelled toward said target and the detonation wave spreads to said second explosive material, whereby said plate penetrator is propelled toward said target in the path cleared by said shaped charge jet.

16. A device for detonating a mine buried in the ground comprising:

a first explosive material with a cavity, a metal liner which covers the surface of said cavity in said first explosive material, a means for detonating said first explosive material, wherein detonation of said first explosive material produces a shaped charge jet from said metal liner, a second explosive material, and an explosive clock, wherein said explosive clock controls ignition of said second explosive material, and a plate penetrator, wherein detonation of said second explosive material propels said plate penetrator toward the ground with sufficient force to cause detonation of the mine.

* * * * *